US008210015B2

(12) United States Patent
Kneppe et al.

(10) Patent No.: US 8,210,015 B2
(45) Date of Patent: Jul. 3, 2012

(54) METHOD AND ROLL STAND FOR MULTIPLY INFLUENCING PROFILES

(75) Inventors: Günter Kneppe, Hilchenbach (DE); Wolfgang Rohde, Remscheid (DE); Sabine Rohde, legal representative, Remscheid (DE)

(73) Assignee: SMS Siemag Aktiengesellschaft, Düsseldorf (DE)

( * ) Notice: Subject to any disclaimer, the term of this patent is extended or adjusted under 35 U.S.C. 154(b) by 0 days.

(21) Appl. No.: 10/584,173

(22) PCT Filed: Nov. 22, 2004

(86) PCT No.: PCT/EP2004/013214

§ 371 (c)(1), (2), (4) Date: May 7, 2007

(87) PCT Pub. No.: WO2005/065853

PCT Pub. Date: Jul. 21, 2005

(65) Prior Publication Data

US 2007/0240475 A1 Oct. 18, 2007

(30) Foreign Application Priority Data

Dec. 23, 2003 (DE) ..... 103 61 490
Apr. 24, 2004 (DE) ..... 10 2004 020 132

(51) Int. Cl.
*B21B 31/18* (2006.01)

(52) U.S. Cl. ..... 72/247; 72/252.5

(58) Field of Classification Search ..... 72/252.5, 72/241.2, 242.4, 247, 12.8
See application file for complete search history.

(56) References Cited

U.S. PATENT DOCUMENTS

| | | | | |
|---|---|---|---|---|
| 4,711,116 | A | 12/1987 | Bald | |
| 4,800,742 | A * | 1/1989 | Feldmann et al. | 72/247 |
| 4,881,396 | A * | 11/1989 | Seidel et al. | 72/247 |
| 5,992,202 | A * | 11/1999 | Turley et al. | 72/247 |
| 6,119,500 | A * | 9/2000 | Ginzburg et al. | 72/247 |
| 6,324,881 | B1 * | 12/2001 | Benedetti et al. | 72/247 |
| 7,316,146 | B2 | 1/2008 | Seilinger et al. | |
| 2003/0015010 | A1 * | 1/2003 | Kobayashi et al. | 72/8.9 |
| 2003/0164020 | A1 * | 9/2003 | Haberkamm et al. | 72/241.2 |

FOREIGN PATENT DOCUMENTS

| | | |
|---|---|---|
| EP | 0 049 798 | 4/1982 |
| EP | 0 091 540 | 10/1983 |
| EP | 0 294 544 | 12/1988 |
| EP | 0 543 014 | 5/1993 |
| JP | 61279304 A * | 12/1986 |
| RU | 1787052 | 1/1993 |
| RU | 1816235 | 5/1993 |
| WO | WO 03/022470 | 3/2003 |

* cited by examiner

*Primary Examiner* — Edward Tolan
*Assistant Examiner* — Matthew G Katcoff
(74) *Attorney, Agent, or Firm* — Lucas & Mercanti, LLP; Klaus P. Stoffel

(57) ABSTRACT

A method for rolling plate or strip in a rolling stand with work rolls supported on backup rolls or on intermediate rolls with backup rolls, wherein the adjustment of the roll gap profile is carried out by axial shifting of pairs of rolls provided with curved contours. The adjustment of the roll gap profile is carried out by at least two pairs of rolls, which have differently curved contours and can be axially shifted independently of each other and whose different contours are calculated by splitting the resultant desired roll gap profiles that describe the roll gap profile into at least two different desired roll gap profiles and are transferred to the pairs of rolls.

16 Claims, 12 Drawing Sheets

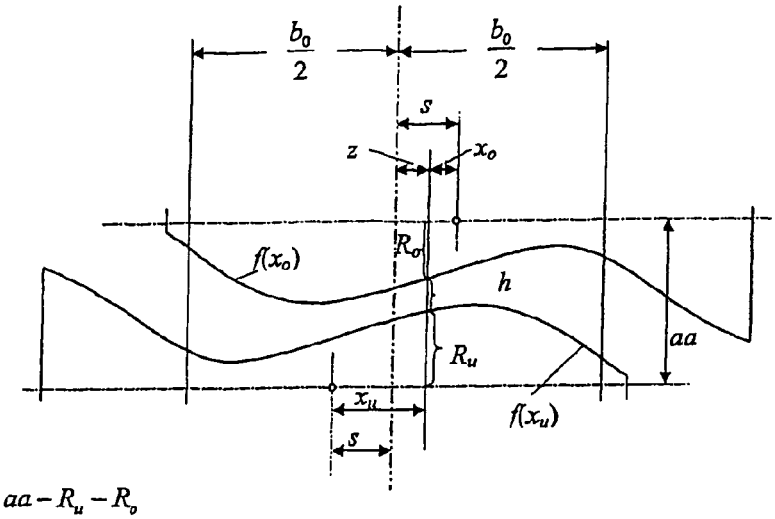

$$h = aa - R_u - R_o$$

$$R_o = f(x_o) \qquad x_o = s - z$$

$$R_u = f(x_u) \qquad x_u = s + z$$

$$\boxed{h = aa - f(s+z) - f(s-z)}.$$

FIG. 1

| | | $z^0$ | $z^2$ | $z^4$ | $z^6$ |
|---|---|---|---|---|---|
| | $n$ $k$ | 0 | 2 | 4 | 6 |
| $x^0$ | 0 | $a_0$ | | | |
| $x^1$ | 1 | $a_1 s$ | | | |
| $x^2$ | 2 | $a_2 s^2$ | $a_2$ | | |
| $x^3$ | 3 | $a_3 s^3$ | $\binom{3}{2} a_3 s$ | | |
| $x^4$ | 4 | $a_4 s^4$ | $\binom{4}{2} a_4 s^2$ | $a_4$ | |
| $x^5$ | 5 | $a_5 s^5$ | $\binom{5}{2} a_5 s^3$ | $\binom{5}{4} a_5 s$ | |
| $x^6$ | 6 | $a_6 s^6$ | $\binom{6}{2} a_6 s^4$ | $\binom{6}{4} a_6 s^2$ | $a_6$ |
| $x^7$ | 7 | $a_7 s^7$ | $\binom{7}{2} a_7 s^5$ | $\binom{7}{4} a_7 s^3$ | $\binom{7}{6} a_7 s$ |
| | | $\sum = c_0$ | $\sum = c_2$ | $\sum = c_4$ | $\sum = c_6$ |

$$\binom{n}{k} = \frac{n(n-1)(n-2)\ldots(n-k+1)}{k!} = \frac{n!}{k!(n-k)!}$$

FIG. 2

FIG. 3
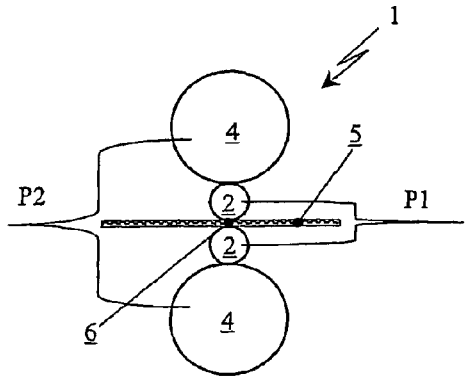
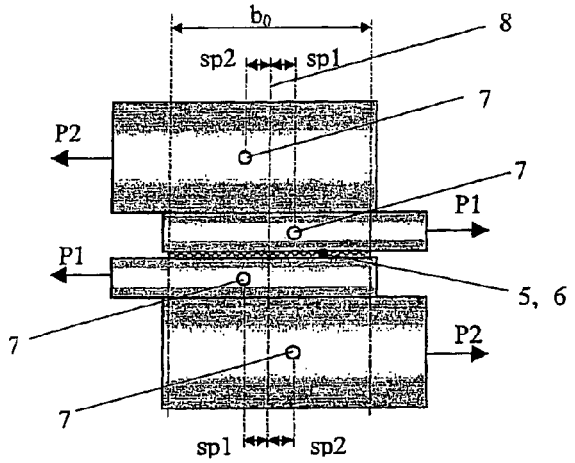
FIG. 3a
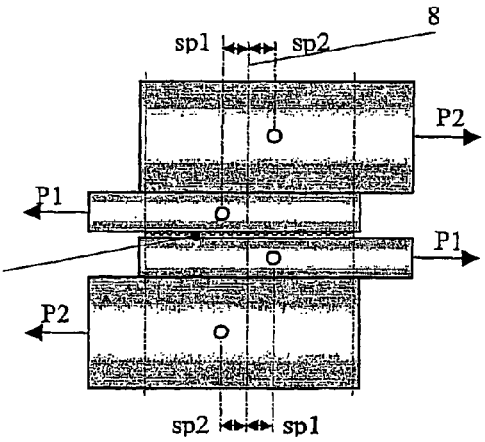
FIG. 3b

FIG. 4
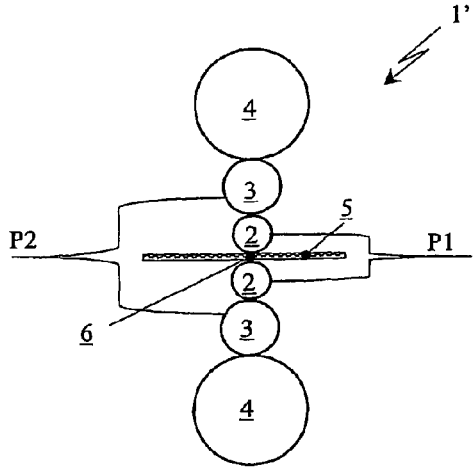
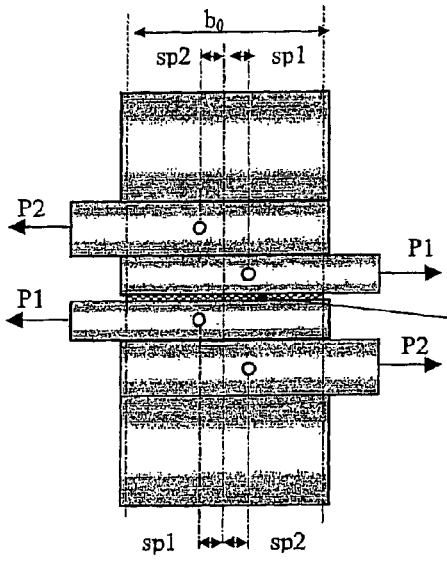
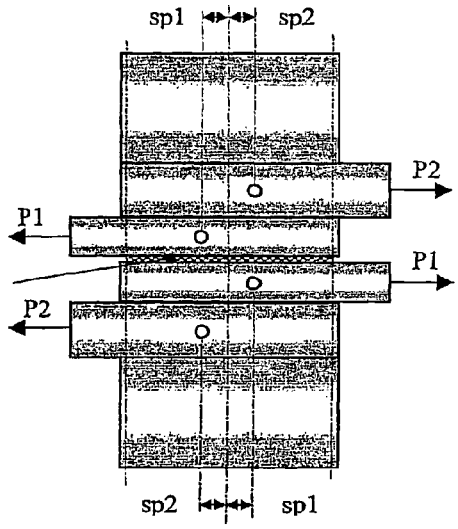
FIG. 4a
FIG. 4b

FIG. 5
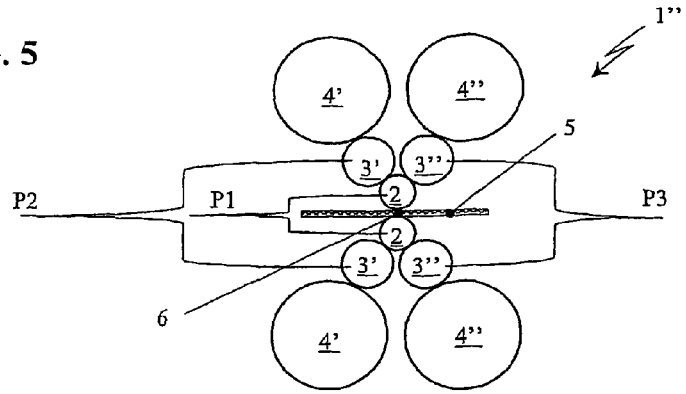
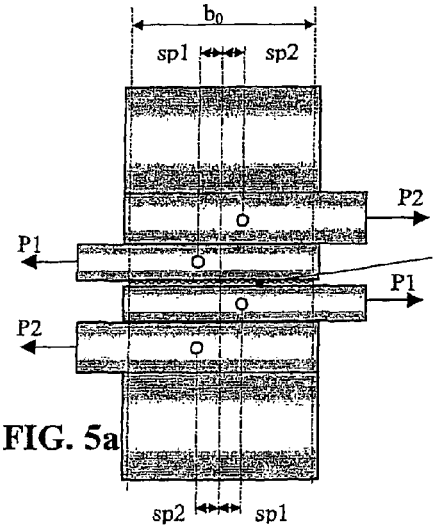
FIG. 5a
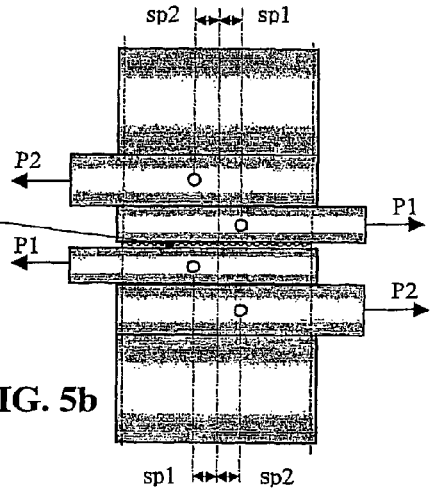
FIG. 5b
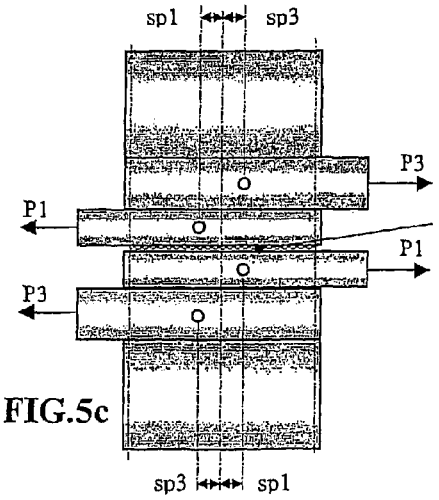
FIG.5c
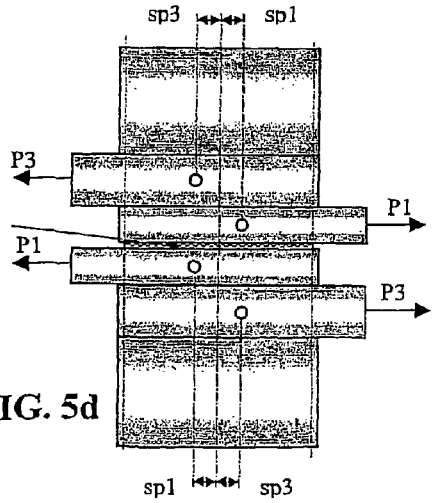
FIG. 5d

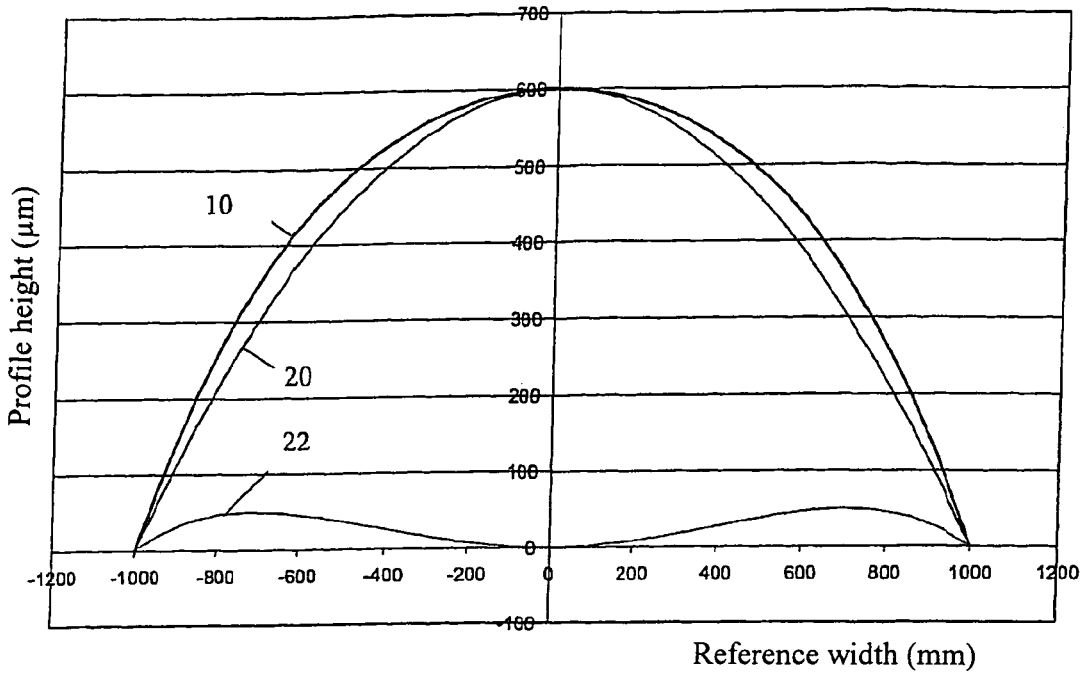
FIG. 6 Desired Roll Gap Profiles
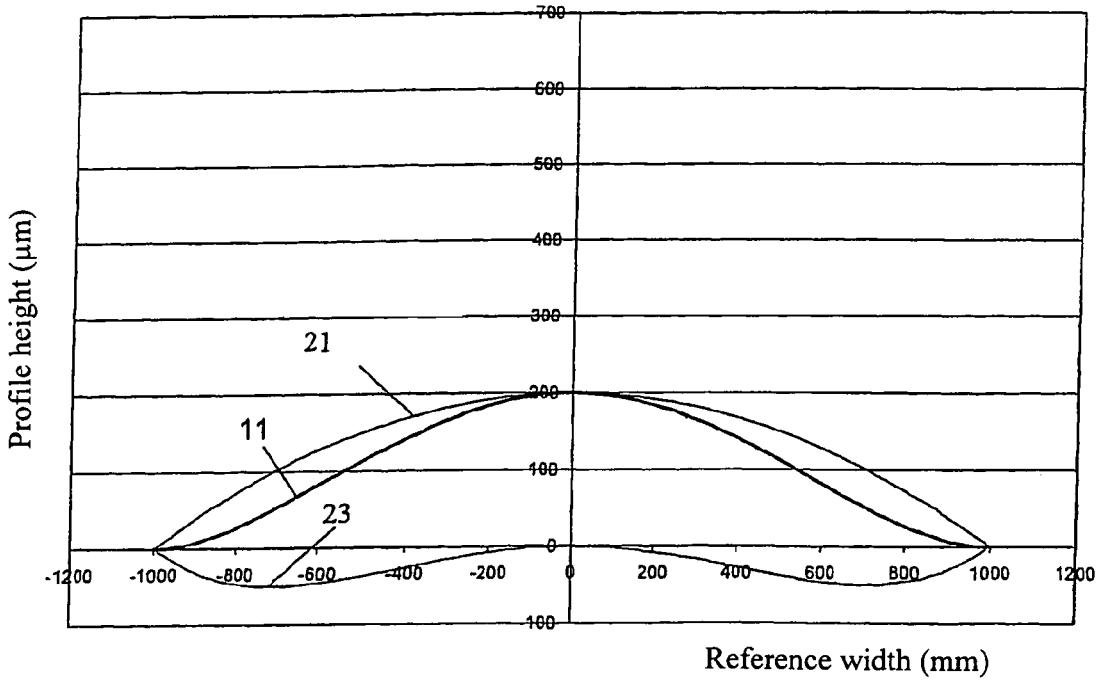
FIG. 7 Desired Roll Gap Profiles

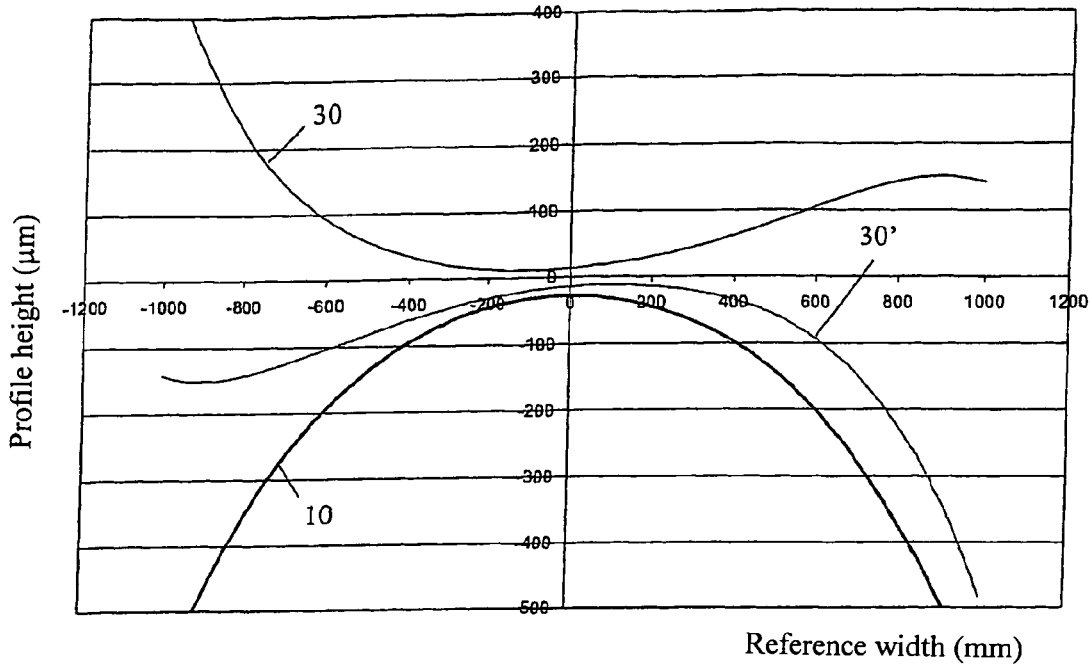
FIG. 8 Resultant Roll Contour
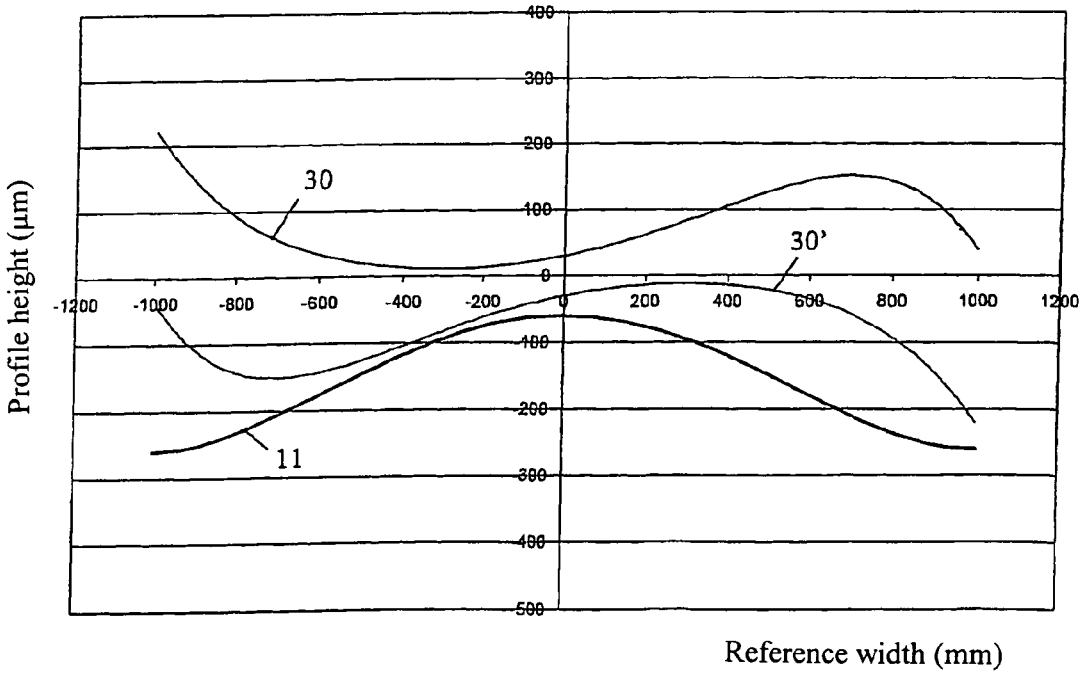
FIG. 9 Resultant Roll Contour

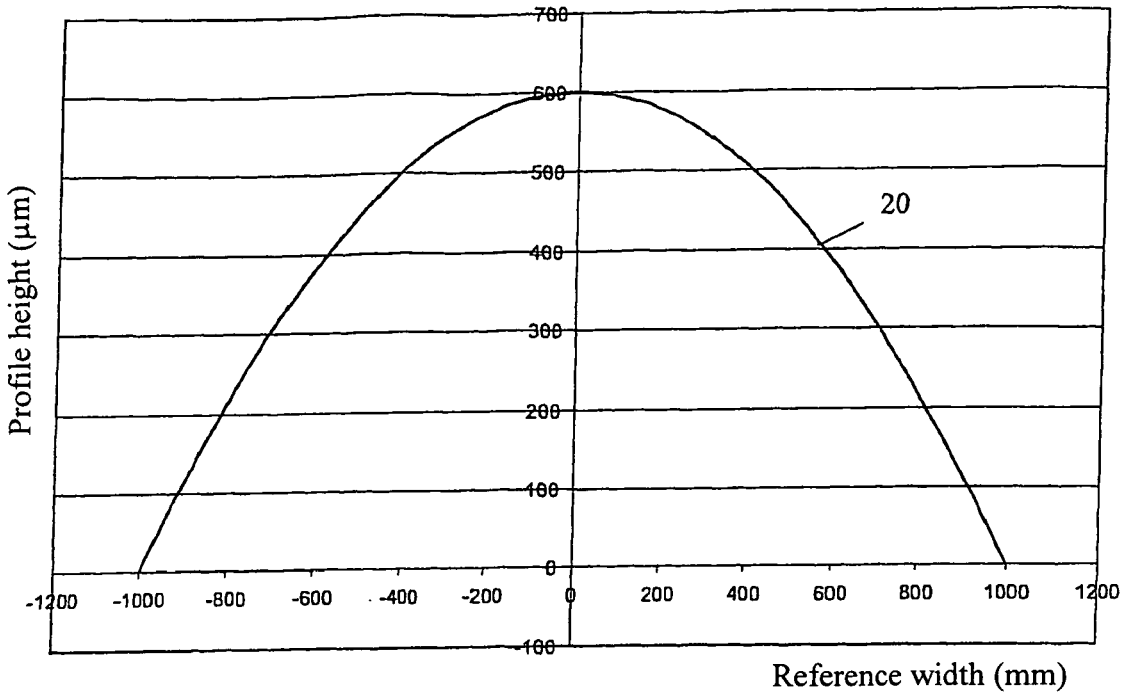
FIG. 10 Desired Roll Gap Profiles
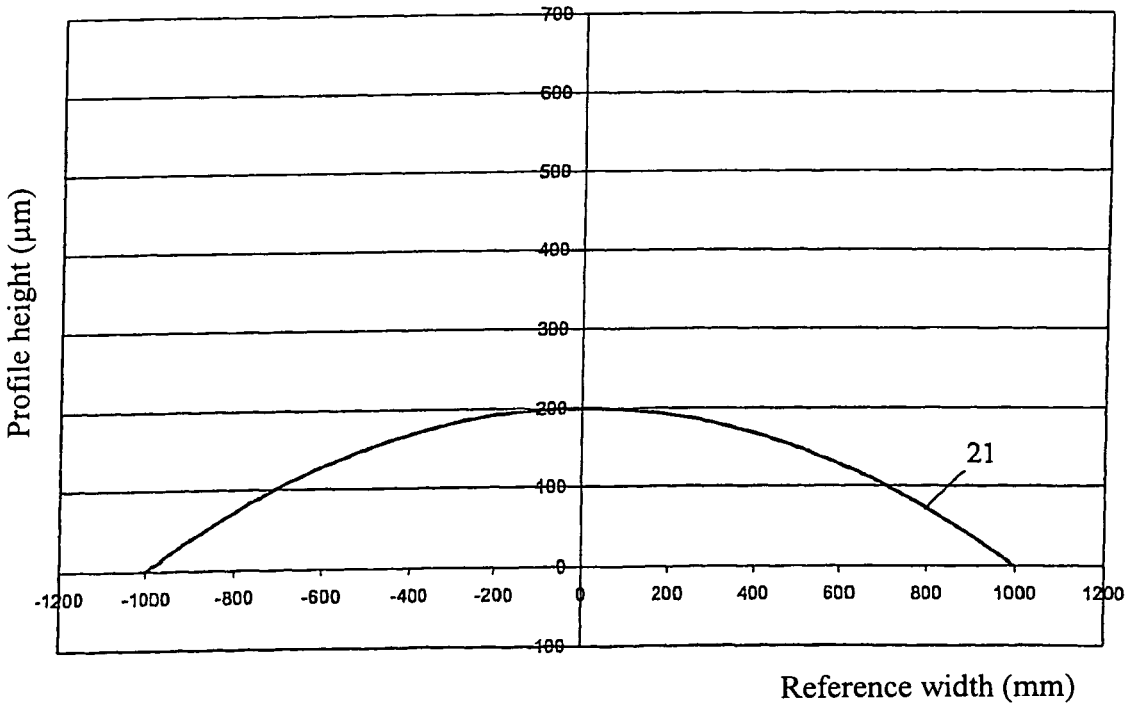
FIG. 11 Desired Roll Gap Profiles

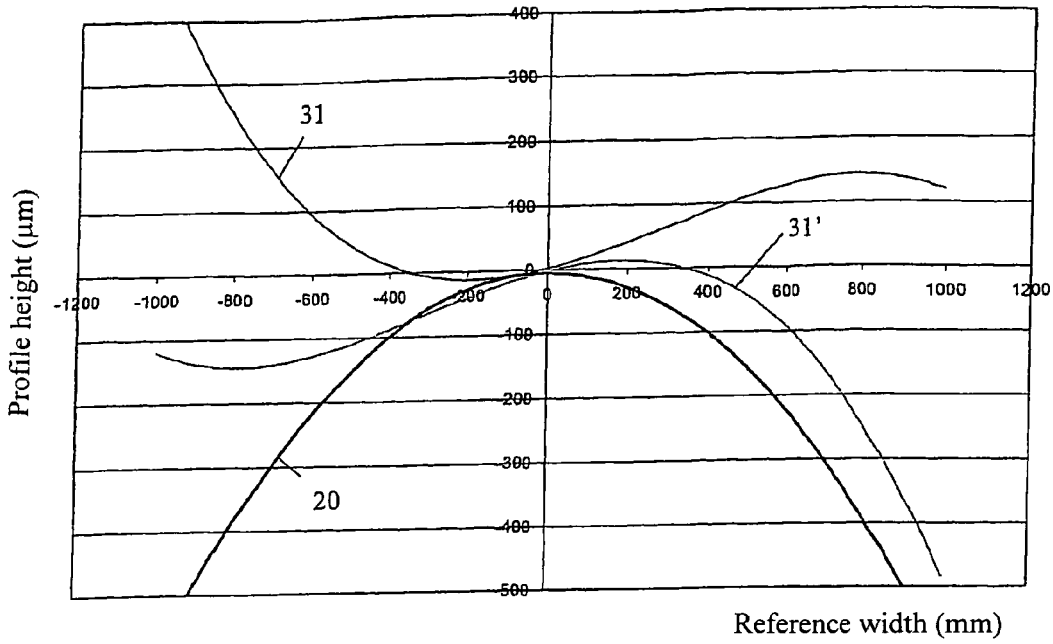
FIG. 12 Resultant Roll Contour
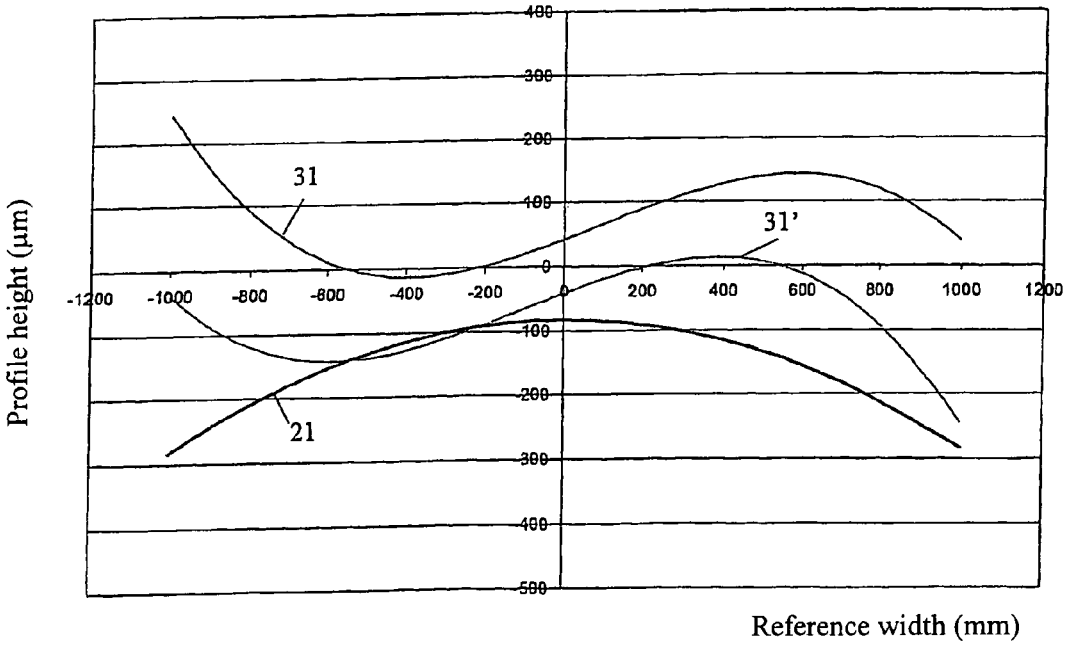
FIG. 13 Resultant Roll Contour

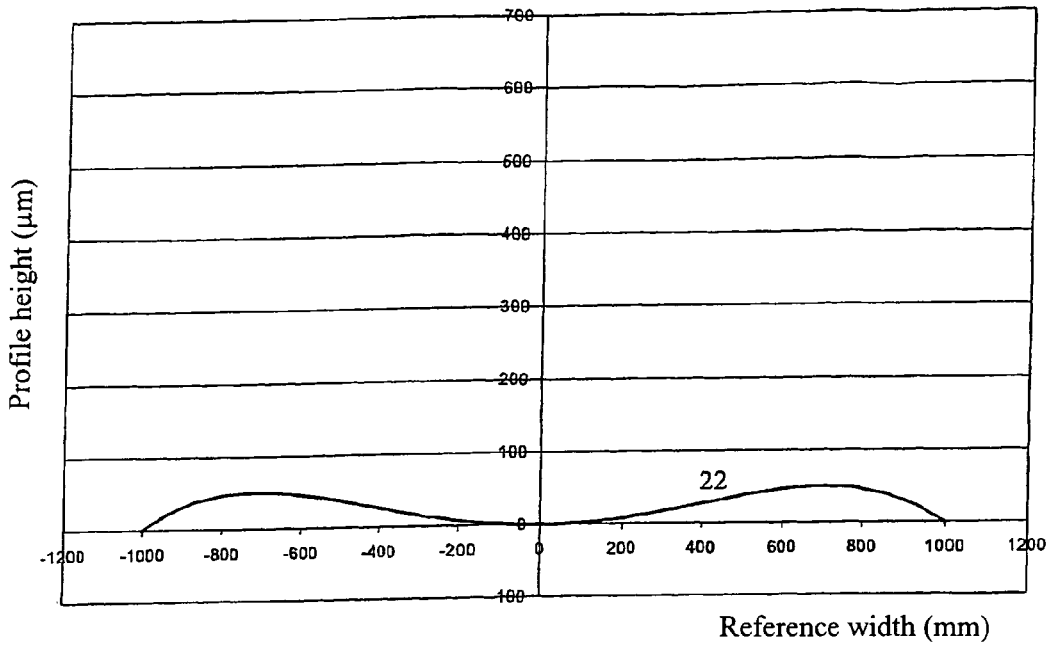
FIG. 14 Desired Roll Gap Profiles
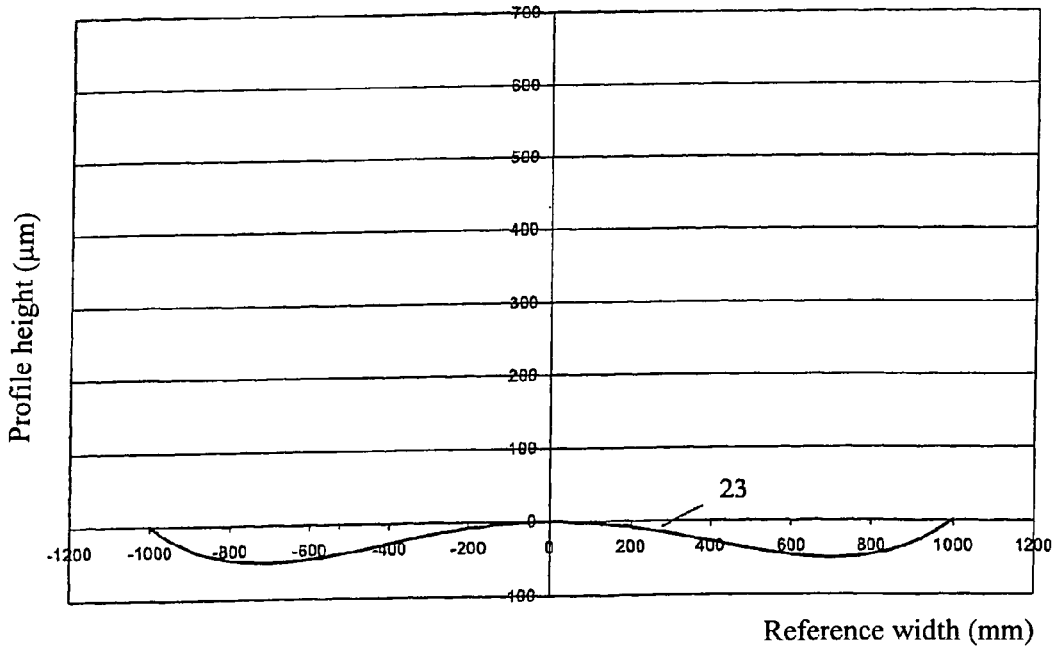
FIG. 15 Desired Roll Gap Profiles

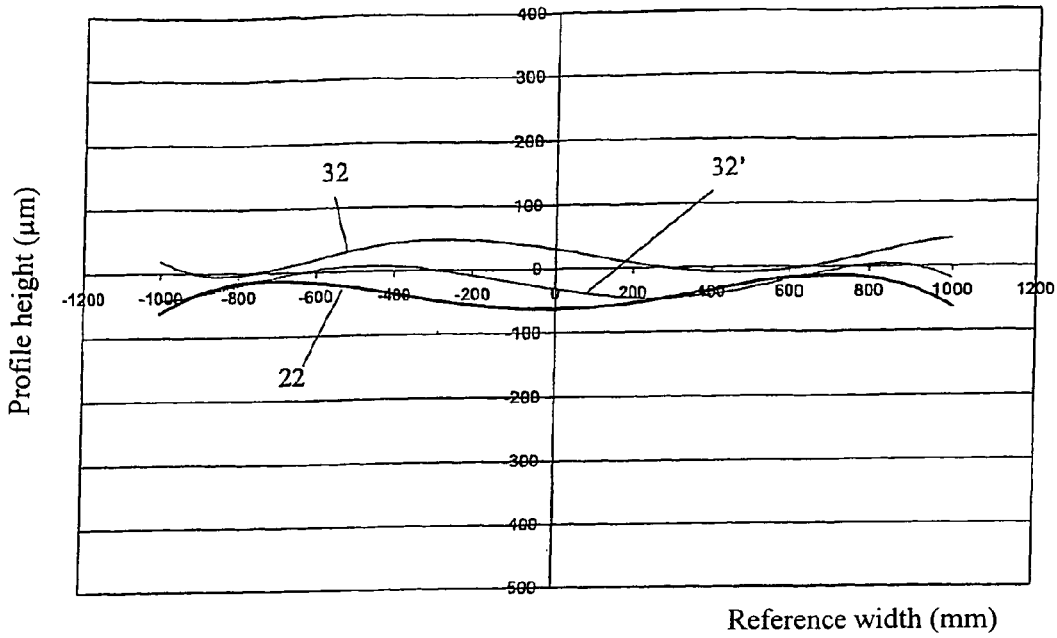
FIG. 16 Resultant Roll Contour
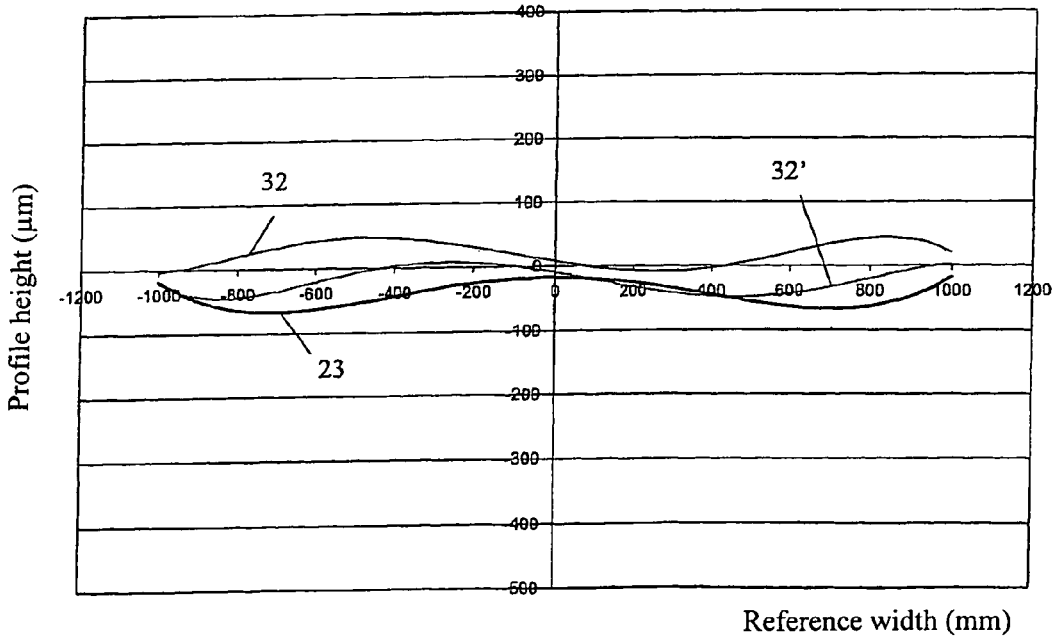
FIG. 17 Resultant Roll Contour

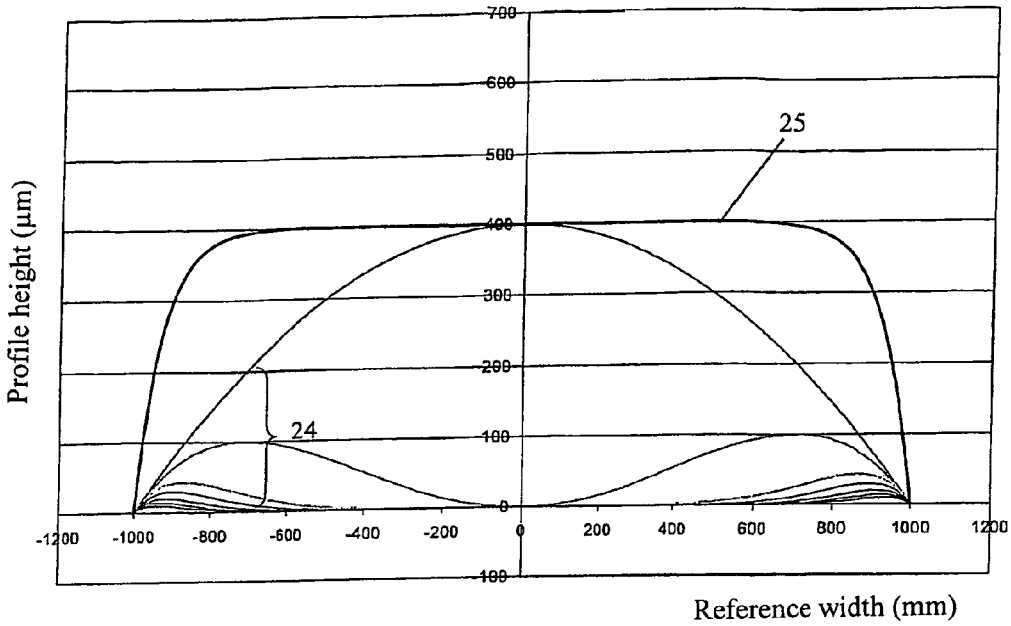
FIG. 18 Desired Roll Gap Profiles
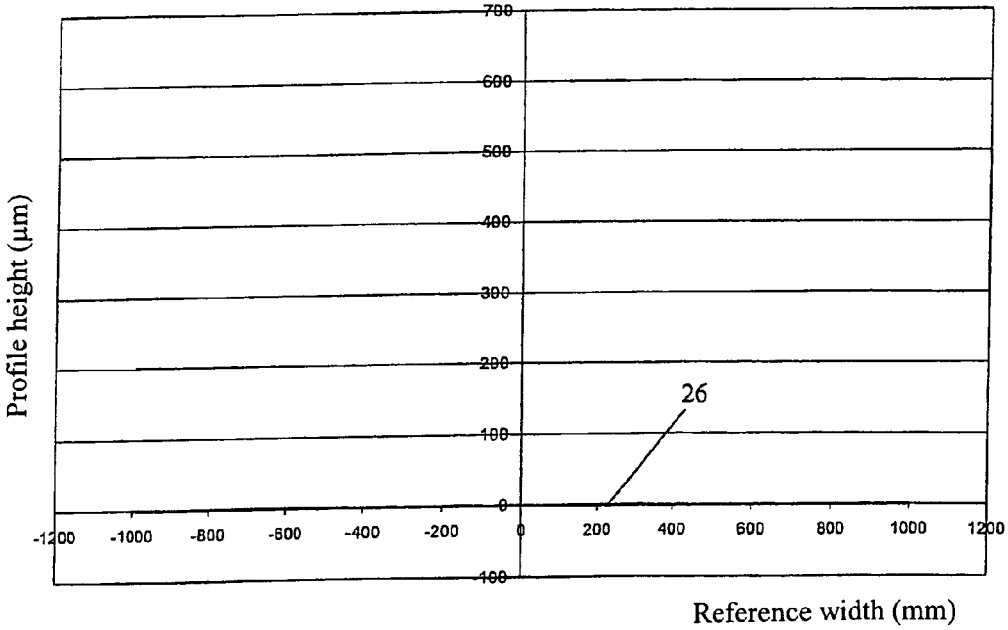
FIG. 19 Desired Roll Gap Profiles

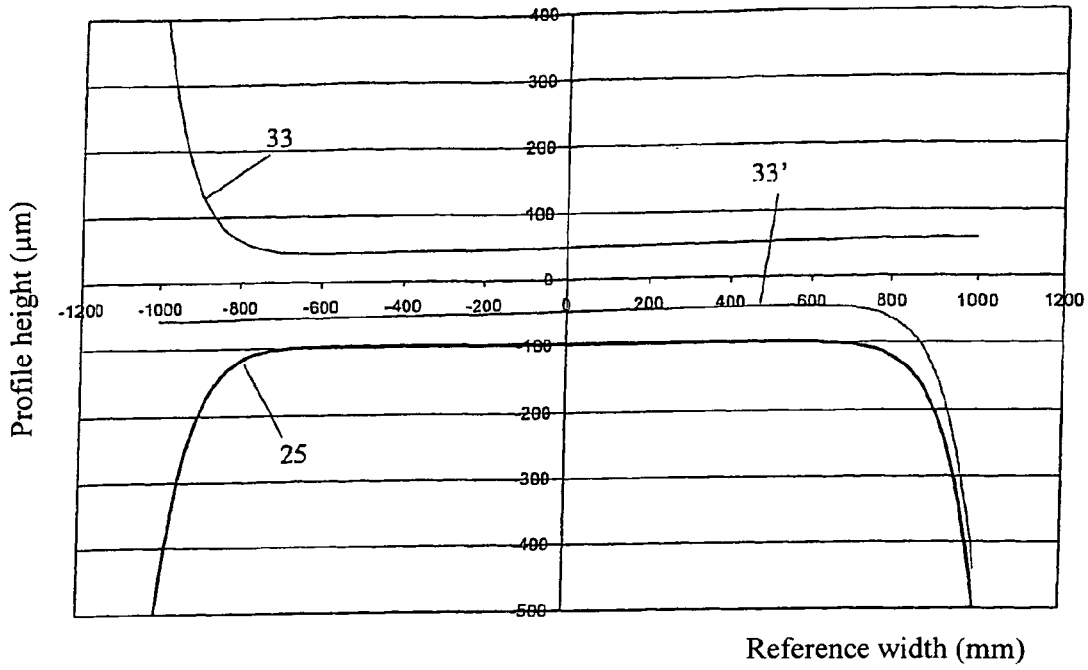
FIG. 20 Resultant Roll Contour
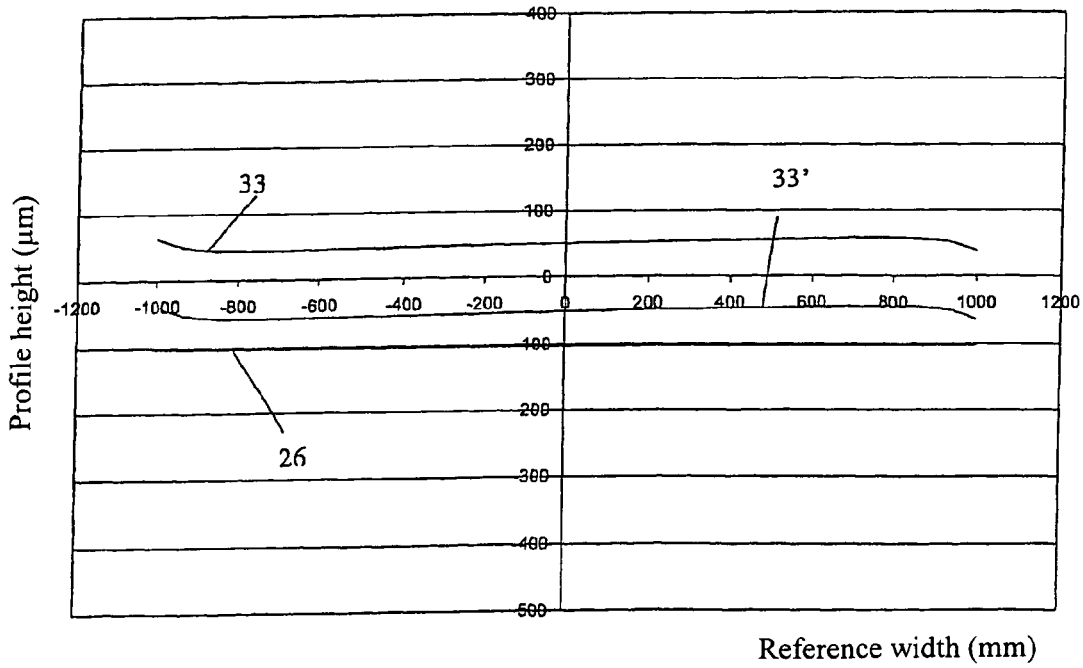
FIG. 21 Resultant Roll Contour

METHOD AND ROLL STAND FOR MULTIPLY INFLUENCING PROFILES

The invention concerns a method and a rolling stand for rolling plate or strip, with work rolls supported on backup rolls or on intermediate rolls with backup rolls, wherein the adjustment of the roll gap profile is carried out by axial shifting of pairs of rolls provided with curved contours. The rolls of selected roll pairs can be shifted axially relative to each other in pairs, and each roll of such a roll pair is provided with a curved profile, which extends towards opposite sides on both rolls of the roll pair over the entire length of the roll barrel. Well-known embodiments are four-high mills, six-high mills, and the various forms of cluster mills configured as one-way mills, reversing mills, or tandem mills.

In the hot rolling of small final thicknesses and in cold rolling, it is necessary to deal with the problem of maintaining flatness by countering two fundamentally different causes of off-flatness with the same adjusting means:

The desired profile of the rolling stock, i.e., the distribution of the thickness of the rolling stock over the width of the rolling stock that is necessary to maintain flatness, decreases proportionally to the nominal thickness of the rolling stock from pass to pass. Especially in the case of one-way mills and reversing mills, the adjusting mechanisms must be capable of realizing the appropriate adjustments.

Depending on the current rolling force, the roll temperature and the state of wear of the rolls, the profile height and profile distribution to be compensated with the adjusting mechanisms change from pass to pass. The adjusting mechanisms must be able to compensate the changes in profile shape and profile height.

Rolling stands with effective adjusting mechanisms for preadjustment of the necessary roll gap and for variation of the roll gap under load are described in EP 0 049 798 B1 and are thus already prior art. This involves the use of work rolls and/or backup rolls and/or intermediate rolls that can be axially shifted relative to each another. The rolls are provided with a curved contour that extends to one end of the barrel. This curved contour extends towards opposite sides on the two rolls of a roll pair over the entire barrel length of both rolls and has a shape with which the two barrel contours complement each other exclusively in a specific relative axial position of the rolls. This measure makes it possible to influence the shape of the roll gap and thus the cross-sectional shape of the rolling stock by only small shift distances of the rolls with the curved contour without any need for direct adaptation of the position of the shiftable rolls to the width of the rolling stock.

The feature of complementation in a specific axial position determines all of the functions that are point-symmetric to the center of the roll gap as suitable. The third-degree polynomial has been found to be the preferred embodiment. For example, EP 0 543 014 B1 describes a six-high rolling stand with intermediate rolls and work rolls that can be axially shifted, wherein the intermediate rolls have cambers that are point-symmetric with respect to the center of the rolling stand and the camber can be expressed by a third-degree equation. This function of the roll contours that is point-symmetric with respect to the center of the roll gap takes the form of a second-degree polynomial in the load-free roll gap, i.e., it takes the form of a parabola. A roll gap of this type has the special advantage that it is suitable for rolling different widths of rolling stock. The variation of the profile height that can be produced by axial shifting allows systematic adaptation to the influencing variables specified above and already covers most of the necessary profile adjustment with a high degree of flexibility.

It was found that the rolls described above can compensate the essential parabolic roll deflection that is determined by quadratic components and extends over the entire length of the barrel. However, especially in the case of the larger rolling stock widths of a product spectrum, deviations are apparent between the adjusted profile and the profile that is actually required due to excessive stretching in the edge region and the quarter region, which manifest themselves in the flatness of the product in the form of so-called quarter waves and can be reduced only with the use of strong additional bending devices, advantageously in conjunction with zone cooling.

To eliminate these disadvantages, EP 0 294 544 proposes that quarter waves of this type be compensated by the use of polynomials of higher degrees. The fifth-degree polynomial has been found to be especially effective. In the unloaded roll gap, it manifests itself as a polynomial of fourth degree and, compared to the second-degree polynomial, effectively influences flatness deviations in the width range of about 70% of the nominal width.

However, this type of contouring of the rolls was found to have the disadvantage that when the rolls are shifted to adjust the roll gap, the effect on the quarter waves changes at the same time. It is just not possible to carry out two different tasks of this type with one adjusting mechanism.

The objective of the present invention is to solve the problems explained above as examples with the use of a simple mechanism and to realize further improvement of the adjusting mechanisms and the strategy for producing absolutely flat plate or strip with a predetermined thickness profile over the entire width of the rolled product.

In accordance with the characterizing features of Claim 1, this objective is achieved by carrying out the adjustment of the roll gap by at least two pairs of rolls, which have differently curved contours and can be axially shifted independently of each other and whose different contours are calculated by splitting the desired roll gap profile effective in the roll gap into at least two different desired roll gap profiles, and are transferred to the pairs of rolls.

Advantageous refinements of the invention are specified in the dependent claims. A rolling stand for rolling plate or strip is characterized by the features of Claim 6 and the features of the additional dependent claims.

In accordance with the invention, the function of the unloaded roll gap necessary for adjusting the roll gap profile is first developed for two selected shift positions as a polynomial of nth degree with even-numbered exponents. In accordance with the invention, each of these two functions to be used for a roll pair in accordance with the prior art is split into a second-degree polynomial with the known positive properties for the preadjustment and a residual polynomial with higher even-numbered powers, which yields the profile 0 in the center line (the profile height in the center line is identical with the profile height at the edges) and shows two maxima on either side of the center line that are suitable for influencing the quarter waves. The roll contours that can be calculated from these polynomials are transferred to at least two roll pairs that can be shifted independently of each another, so that, in accordance with the invention, the adjustment of the desired roll gap profile can now be carried out by at least two roll pairs with different roll contours by axial shifts that are independent of each another. In accordance with the invention, this splitting of the roll contour of a known roll pair into at least two roll pairs that can be shifted independently of each other thus allows sensitive control and correction of the roll gap to produce absolutely flat plate or strip with a predetermined thickness profile.

The mathematical background for realizing the stated objective is explained below with reference to FIG. 1, which presents notation for setting up the roll function for the roll contour of an individual pair of rolls (in FIG. 1, the subscript "o" denotes the upper roll, and the subscript "u" denotes the lower roll of the roll pair):

The roll gap obeys the function $$h=aa-f(s+z)-f(s-z). \tag{G1}$$

in which the meanings of the individual variables are shown in FIG. 1.

Using the Taylor series and a few elementary transformations, this equation can be expanded to $$h = aa - 2\left[f(s) + \frac{f^{(2)}(s)}{2!}z^2 + \frac{f^{(4)}(s)}{4!}z^4 + \frac{f^{(6)}(s)}{6!}z^6 + \ldots\right]. \tag{G2}$$

The function of the roll gap thus takes the form of the difference of the axial separation of the rolls and twice the sum of even-numbered powers, i.e., it takes the form of a function that is symmetric with respect to the center of the stand. This result is obviously obtained without the determination of a radius function and is therefore valid for every differentiable function. The selected radius function determines, by its derivatives, only the coefficients of the power terms.

In analogy to a symmetrically contoured pair of rolls, one may imagine that a nonshiftable, symmetrically contoured roll pair with the ideal radius Ri(s,z) is present in the stand. The contours of these imagined rolls vary symmetrically with respect to the center of the roll by roll shifting of the actual rolls in opposite directions.

The following holds:

$$h=aa-2Ri \tag{G3}$$

According to Equations (G2) and (G3), the ideal roll radius Ri obeys the function $$Ri = f(s) + \frac{f^{(2)}(s)}{2!}z^2 + \frac{f^{(4)}(s)}{4!}z^4 + \frac{f^{(6)}(s)}{6!}z^6 + \ldots\ . \tag{G4}$$

The function of the roll profile of each of the two shiftable real rolls is given by $$R=f(x)=a_0+a_1x+a_2x^2+a_3x^3+a_4x^4+a_5x^5+a_6x^6+a_7x^7+\ldots \tag{G5}$$

After the necessary differentiations according to Equation (G4) have been performed and the results have been substituted in Equation (G4), the equation for the ideal roll radius is available $$Ri = \sum_{n=0}^{n=p}\sum_{k=0}^{k=n}\binom{n}{k}a_n s^{n-k} z^k \tag{G6}$$

$$n = 0, 1, 2, 3, \ldots\ p$$

$$k = 0, 2, 4, \ldots\ n.$$

FIG. 2 shows an organized presentation of the coefficients of Equation (G6) up to the sixth power in a coefficient matrix and the combination to the polynomial $$Ri=c_0+c_2z^2+c_4z^4+c_6z^6+c_8z^8+\ldots \tag{G7}$$

with the initially still unknown coefficients $c_k$, which are formed by the rule of (G6) from the coefficients of Equation (G5).

Equation (G7) describes the roll profile with which the ideal roll should be furnished in a certain shift position. For this purpose, however, the polynomial must be split into individual polynomials, of which each individual one can be dimensioned with a value that is understandable for operational practice.

The splitting of the nth-degree polynomial into the individual polynomials is accomplished by taking the differences of the terms of ith degree from the next lower power and is illustrated below for a sixth-degree polynomial.

In Equation (G7), negative additive terms are inserted with a power degree that is lower by 2 in each case and with the coefficient $q_k$, which at the same time are also positively added to the next lower power.

$$Ri=c_0+q_0z^0-q_0z^0+c_2z^2+q_2z^2-q_2z^2+c_4z^4+q_4z^4-q_4z^4+c_6z^6 \tag{G8}$$

The resulting equivalent polynomial is arranged into new terms:

$$Ri=Ri_0+Ri_2+Ri_4+Ri_6 \tag{G9}$$

The terms of this equation represent the profile components of the individual power degrees in the overall profile. According to Equation (G8), we have:

$$Ri_0=c_0+q_0z^0 \text{ for the nominal radius} \tag{G10}$$

$$Ri_2=-q_0z^0+c_2z^2+q_2z^2 \text{ for the second-degree component} \tag{G11}$$

$$Ri_4=-q_2z^2+c_4z^4+q_4z^4 \text{ for the fourth-degree component} \tag{G12}$$

$$Ri_6=-q_4z^4+c_6z^6+q_6z^6 \text{ for the sixth-degree component} \tag{G13}$$

The further course of the calculation is illustrated with the example of the term $Ri_6$:

By simple transformation, we obtain:

$$Ri_6=(c_6+q_6-q_4z^{-2})z^6 \tag{G14}$$

The values $q_k$ in (G10) to G13) are to be selected in such a way that the $Ri_k$ for $z=z_R=b_0/2$ become 0, where $b_0$ is the reference width of the set of rolls.

$$0=(c_6+q_6-q_4z_R^{-2})z_R^6.$$

From this, we obtain:

$$(c_6+q_6)=q_4z_R^{-2}. \tag{G15}$$

The value $q_6$ is equal to 0 for the highest degree considered here, the sixth degree, since it is assigned to the eighth degree, which is not present. Numerically, therefore, it is also necessary to begin the resolution with the highest degree.

Substitution of Equation (G15) in Equation (G14) yields $$Ri_6 = (q_4z_R^{-2} - q_4z^{-2})z^6 = q_4\left(\frac{z^2}{z_R^2} - 1\right)z^4. \tag{G16}$$

This is already the equation for the functional curve of the profile component of the sixth degree in the overall profile. For z=0 and $z=z_R$, the profile component 0 is obtained, as required. The extreme value of this function is the profile height, which is strived for as a preset value.

The extreme values are obtained from the first derivative set to 0 with $$\frac{\partial Ri_6}{\partial z} = q_4\left(\frac{6z^5}{z_R^2} - 4z^3\right).$$

After setting to zero, the following is obtained $$z_{6\max} = \pm\sqrt{\frac{4}{6}}\, z_R \tag{G17}$$

the position of each of the two extreme values of the function for the profile component of the sixth degree located symmetrically with respect to the center of the stand.

Substitution of (G17) in (G16) leads to the extreme value itself with $$Ri_{6\max} = q_4\left(\frac{4}{6} - 1\right)\left(\frac{4}{6}z_R^2\right)^2 = -q_4\frac{1}{3}\left(\frac{2}{3}z_R^2\right)^2. \tag{G18}$$

The values for $Ri_{kmax}$ are identical with the profile components of the ideal rolls. Since the roll profile, the so-called crown, or the profile height, is calculated with respect to the roll diameter, we have $$Cr_n = 2Ri_{nmax}. \tag{G19}$$

A direct relation between the crown values and the q values follows with $$Cr_6 = -2\frac{1}{3}\left(\frac{2}{3}z_R^2\right)^2 q_4 \tag{G20}$$

Performing the calculation for the remaining terms $Ri_4$ and $Ri_2$ of Equation (G9) leads to the set of equations:

second degree:

$$Cr_2 = -2q_0 \tag{G21}$$

fourth degree:

$$Cr_4 = -2\frac{1}{2}\left(\frac{1}{2}z_R^2\right)q_2$$

sixth degree:

$$Cr_6 = -2\frac{1}{3}\left(\frac{2}{3}z_R^2\right)^2 q_4$$

after performing the calculation.

The term $Ri_0$ of Equation (G9) can be freely selected as the nominal radius of the roll.

As is readily apparent, the polynomial can be further expanded by continuation of the series indefinitely in the direction of higher degrees. For example, we have eighth degree:

$$Cr_8 = -2\frac{1}{4}\left(\frac{3}{4}z_R^2\right)^3 q_6$$

and tenth degree:

$$Cr_{10} = -2\frac{1}{5}\left(\frac{4}{5}z_R^2\right)^4 q_8.$$

To determine the coefficients of Equation (G5) for the polynomial functions of the roll cross sections, two shift positions $s_1$ and $s_2$ are to be selected, for each of which the desired profile is to be determined by selection of the crown values of $Cr_2$ to $Cr_n$. Between these two profiles, for example, in the maximum and in the minimum shift position, the profiles will vary continuously by the roll shift. Since the individual power degrees can be dimensioned independently of one another, the absolute requirement of complementation of the roll profiles of the upper roll relative to the lower roll becomes unnecessary. However, this can be easily brought about intentionally by uniformly establishing, for all profile degrees, the profile height of 0 for one of the two freely selectable shift positions, if necessary, also beyond the real shift distance.

After selection of the crown values, the values for $q_k$ are obtained from the set of Equations (G21). The values for $c_k$ are determined by Equation (G15), and this equation is to be written down for the other terms in analogy to the set of Equations (G21). After substitution into Equations (G10) to (G13), the complete functional curves of the individual power degrees are available. The overall profile then appears, in accordance with Equation (G9), in the form of individual superimposed layers and can also be calculated with the identical Equation (G7).

The calculation of the coefficients of the polynomial for the contours of the shiftable rolls is accomplished by combining the coefficients of Equation (G7) with Equation (G6).

As described above, Equation (G7) exists for two shift positions $s_1$ and $s_2$. Setting the two Equations (G7) equal to Equation (G6) yields the necessary defining equations for the coefficients $a_1$ of the polynomial for the roll cross section according to the selected power degree. The individual defining equations can be read directly from the coefficient chart of FIG. 2. The coefficient $a_1$ remains undetermined, since it has no effect on the profile shape of the roll. It determines the conicity of the roll and therefore requires a different design criterion, which will be explained below at the contact of a profiled roll with a cylindrically shaped intermediate roll or backup roll.

During the rolling operation, the elevated profile regions of the profiled rolls will become embedded in the cylindrical roll by elastic deformation in the contact zone and under certain circumstances will cause a nonparallel position of the two rolls. To prevent crossing of the rolls, the slope $a_1$ of the work roll contour must be dimensioned in such a way that the axes of the two rolls are parallel to each other. In this case, a center line that is also parallel to the axes of the two rolls is formed in the contact zone. The radius of this center line with respect to the work roll is $R_w$. A force element dF can then be defined by a length element dz of the work roll:

$$dF = C(R - R_w)dz. \tag{G22}$$

with C as a length-specific spring constant of the flattening (dimension $N/mm^2$). The force element dF produces a moment element over the distance z, which moment element causes tilting of the rolls. To ensure that the required parallelism of the axes is maintained, the following is required for the integral of the moment elements over the contact length:

$$M_K = \int_{z=-z_R}^{z=z_R} dM_K = \int_{z=-z_R}^{z=z_R} dF \cdot z = \int_{z=-z_R}^{z=z_R} C(R - R_w) z dz = 0. \quad \text{(G23)}$$

The length-specific spring constant may be set constant over the contact length. This leads to:

$$\int_{z=-z_R}^{z=z_R} (R - R_w) z dz = 0 \quad \text{(G24)}$$

as the defining Equation (G24) for the slope $a_1$.

Substitution of Equation (G5) yields the defining equation for $a_1$ after integration over the reference width and a few elementary transformations:

$$a_1 = -3\left(\frac{1}{5}a_3 z_R^2 + \frac{1}{7}a_5 z_R^4 + \frac{1}{9}a_7 z_R^6 + \frac{1}{11}a_9 z_R^8 + \ldots\right). \quad \text{(G25)}$$

It is immediately apparent that Equation (G25) also applies to profiled rolls that are in contact with the profiled roll of another pair of rolls if the coefficient $a_1$ of this contact roll was also dimensioned with Equation (G25).

After completion of the calculation performed, by way of example, for the sixth degree, with Equations (G14) to (G20), for all power degrees in question, it becomes apparent that two extreme values that are symmetric with respect to the stand center are always established for the power degrees higher than 2 in the ideal set of rolls and thus in the roll gap, whose separation, however, increases with increasing power degree. The power degree of 2 has only one extreme value in the center of the set of rolls. In accordance with the invention, this presents the solution of assigning one polynomial for power degree 2 to a pair of rolls and a residual polynomial, which covers all higher power degrees, to a second set of rolls.

The two or more pairs of rolls will be selected differently, depending on the design of the stand. In the case of a six-high stand, for example, the shiftable intermediate rolls will be provided with a profile that produces the second-degree polynomial in the roll gap. The shiftable rolls are suited for the residual polynomial and serve to influence the quarter waves or to achieve some other specific effect on the profile. Depending on the position of a pair of rolls in the stand combination, the profile heights of the profiles to be set by the given roll pair will also be increased in a way that is already well known in itself in order to improve the penetration to the roll gap, especially in the case of roll pairs located farther from the roll gap.

The fact that even in the case of large widths of the rolling stock, the quarter waves can be sensitively influenced by the shift of the work rolls has also been found to be especially advantageous. If no quarter waves are present, then the work rolls remain in the zero position and behave as uncountoured rolls.

The two maxima in the residual polynomial are located in a position symmetric with respect to the center line, which can be varied by the degree of the polynomial. This results in the possibility—depending on the stand design—of creating a further adjustment option for eighth waves or edge waves by means of another shiftable roll pair. Naturally, it also continues to be possible to introduce this variant in the simplest way by the roll change.

In individual cases, it may turn out to be advantageous additionally to superimpose one or more degrees on the roll pair to produce a second-degree polynomial. This could make sense if the stands are operated with almost constant rolling stock widths.

In addition, it is possible, by combining all available profile forms of powers 2 to n, to create very specific profile forms by suitable dimensioning of the profile height of each power and to assign these profile forms to a roll pair. For example, a profile form is possible in which the roll gap remains essentially parallel and varies only in the area of the edge of the rolling stock.

The additional use of work roll and intermediate roll bending systems and roll cooling systems for dynamic corrections and for the elimination of residual defects remains unaffected.

Further details, characteristics, and features of the invention are explained below with reference to specific embodiments, which are shown in schematic drawings and illustrate the effectiveness of the measures of the invention.

FIG. 1 shows terms used to set up the roll gap and roll function.

FIG. 2 shows a coefficient chart of the function Ri(s,z).

FIG. 3 shows a schematic cross section of a four-high stand.

FIGS. 3*a* and 3*b* show possible shifting ranges of individual roll pairs of FIG. 3.

FIG. 4 shows a schematic cross section of a six-high roll stand.

FIGS. 4*a* and 4*b* show possible shifting ranges of individual roll pairs of FIG. 4.

FIG. 5 shows a schematic cross section of a ten-high roll stand.

FIGS. 5*a* to 5*d* show possible shifting ranges of individual roll pairs of FIG. 5.

FIGS. 6 and 7 show desired roll gap profiles, formed from the sum of profiles of the second and fourth degree for two selected shift positions +100/−100 mm.

FIGS. 8 and 9 show the resultant roll contour of desired roll gap profiles of FIGS. 6 and 7.

FIGS. 10 and 11 show desired roll gap profiles for a profile of second degree for two selected shift positions +100/−100 mm.

FIGS. 12 and 13 show the resultant roll contour of the desired roll gap profiles of FIGS. 10 and 11.

FIGS. 14 and 15 show desired roll gap profiles for a profile of the fourth degree for two selected shift positions +100/−100 mm.

FIGS. 16 and 17 show the resultant roll contour of the desired roll gap profiles of FIGS. 14 and 15.

FIGS. 18 and 19 show desired roll gap profiles, formed from the sum of profiles of the second to sixteenth degree for two selected shift positions +100/−100 mm.

FIGS. 20 and 21 show the resultant roll contour of the desired roll gap profiles of FIGS. 18 and 19.

FIGS. 1 and 2 have already been described in detail above.

In FIGS. 3 to 5, the possible shifting ranges of individual shiftable roll pairs (P1, P2, P3) with differently curved contours are shown for the examples of selected rolling stands (1, 1', 1"). FIG. 3 shows a side view of a four-high stand 1. It consists of a shiftable roll pair P1, the work rolls 2, and another shiftable roll pair P2, i.e., the backup rolls 4. The rolling stock 5 is rolled out in the roll gap 6 between the work rolls 2.

FIGS. 3*a* and 3*b*, in which the four-high stand 1 of FIG. 3 is shown turned by 90°, show the possible shifting ranges of the roll pairs P1 and P2. Starting from the center 8 of the stand, shift distances of the roll centers 7 by the amount sp1 for the roll pair P1 and the amount sp2 for the roll pair P2 are possible to the right and left, respectively. The shifts are limited by the reference width $b_0$ if a roll edge is shifted into the vicinity of the rolling stock edge of a rolling stock width corresponding to the reference width. In FIG. 3*a*, for example, the upper roll of the roll pair P1 is shifted to the right by sp1, and the accompanying lower roll is shifted to the left by sp1, while the upper roll of the roll pair P2 is shifted to the left by sp2, and the accompanying lower roll is shifted to the right by sp2. In FIG. 3*b*, these shifts are made with mirror-symmetry to FIG. 3*a*. The juxtaposition of these two possible extreme positions makes it clear how and to what limits a shift of the two roll pairs P1, P2 is possible. In this connection, the shift direction of each pair of rolls is independent of the shift direction of the other pair of rolls.

FIG. 4 shows a side view of a six-high rolling stand 1'. It consists of a shiftable roll pair P1, the work rolls 2, another shiftable roll pair P2, the intermediate rolls 3, and another, nonshiftable, roll pair, the backup rolls 4. FIGS. 4*a* and 4*b*, in which the six-high rolling stand 1' of FIG. 4 is shown turned by 90°, show the possible shifting ranges of the roll pairs P1 and P2. The rolls are shifted in the same way as shown in FIGS. 3*a* and 3*b* up to the maximum possible shift amount sp1 or sp2. In this case, the intermediate rolls 3, as roll pair P2, take on the role of the backup rolls 4 of the four-high stand 1 in FIGS. 3*a* and 3*b*. Here again, the shift direction of each pair of rolls is independent of the shift direction of the other pair of rolls.

FIG. 5 shows a side view of a ten-high rolling stand 1" as an example of a cluster mill. It consists of a shiftable roll pair P1, the work rolls 2, a shiftable roll pair P2, the intermediate rolls 3', another shiftable roll pair P3, the intermediate rolls 3", and the two pairs of backup rolls 4' and 4".

FIGS. 5*a* and 5*b*, in which the ten-high rolling stand 1" of FIG. 5 is shown turned by 90°, show, in a section through the rolls 4'-3'-2-2-3'-4', the possible shifting ranges of the roll pair P1, the work rolls 2, and the roll pair P2, the intermediate rolls 3' shown on the left in FIG. 5. The maximum shift distance is again sp1 and sp2, respectively.

In a section through the rolls 4"-3"-2-2-3"-4", FIGS. 5*c* and 5*d* again show the roll pair P1, but this time together with the roll pair P3, i.e., with the intermediate rolls 3" that are located on the right in FIG. 5 with a maximum shift distance sp3.

The two backup rolls 4' and 4" are also designed to be unshiftable in this embodiment of the ten-high rolling stand 1". It is thus apparent, especially in connection with the ten-high rolling stand 1", that there is a great variety of different combinations with a correspondingly large available number of shiftable roll pairs with differently curved roll contours, so that pairwise roll shifting and thus sensitive influencing of the roll gap 6 can be carried out.

The desired range of adjustment and the shape of the roll gap 6 for two selected shift positions, the shift position of +100 mm and the shift position of −100 mm, are plotted as examples in the graphs in FIGS. 6 to 21 for different rolling stands 1, 1', 1" (see FIGS. 3, 4, 5) with a reference width of 2,000 mm (x-axes in mm in each case). The individual desired roll gap profiles for the two selected shift positions +100/−100 mm are defined by the choice of the profile components, which is determined by the degree of the polynomial and the profile height to be realized at the shift position in question. In FIGS. 6 to 17, the following profile heights (y-axes in μm in each case) were selected:

For the shift position +100 mm:
second degree with 600 μm profile height
fourth degree with 50 μm profile height
For the shift position −100 mm:
second degree with 200 μm profile height
fourth degree with −50 μm profile height The profile height of the function of each polynomial varies continuously with the shift position between +100 mm and −100 mm. Accordingly, the roll gap profile 6, which represents the sum of the functional curves of the selected polynomials, also varies continuously.

These profile heights determined above lead—as described—with the aid of elementary mathematics to roll contours of the upper and lower roll that can be uniquely calculated for the reference width of the roll pairs P1, P2, P3, with which continuous variation of the roll gap 6 can be achieved. The roll gap profile 6 is identical with the functional curve of the height of the roll gap and is plotted in each case for a comparison with the selected profile. Depending on the shift position, a sector of the roll contour from the contour extending over the entire length of the roll can be seen in each of the graphs.

In FIGS. 6 and 7, in a form of representation in accordance with the invention, the desired roll gap profiles for the two selected shift positions of a prior-art roll pair are separated into the components of a second-degree polynomial and a residual fourth-degree polynomial.

For a shift position of +100 mm and for the predetermined profile heights, we obtain the curves plotted in FIG. 6 for the desired roll gap profile 10 and for the therein contained component 20 of the polynomial of second degree and component 22 of the residual polynomial of fourth degree. Analogously, for a shift position of −100 mm and for the much lower profile height, FIG. 7 shows the corresponding curves for the desired roll gap profile 11 and its component 21 of the second-degree polynomial and its component 23 of the residual fourth-degree polynomial.

In a distribution, in accordance with the invention, of the roll contourings to at least two roll pairs P1 and P2, the rolls of a roll pair, e.g., P1, must be contoured in such a way that they produce the symmetric desired roll gap profiles of second degree 20 and 21 in the two selected shift positions. The rolls of the other roll pair P2 must then be contoured in such a way that they produce the desired roll gap profiles of fourth degree 22 and 23 in their two selected shift positions. If the two roll pairs P1 and P2 are in the positions which produce the desired roll gap profiles 20 and 22, then the resultant profile 10 is obtained in the roll gap 6. In the opposite shift positions, the resultant profile 11 is obtained. To determine the roll contour of a roll pair, two desired roll gap profiles for two different shift positions are always needed. The shift positions may be completely different for the selected roll pairs.

FIGS. 8 and 9 show the roll contours 30 and 30' of the upper roll and lower roll, respectively, which are calculated from the desired roll gap profiles 10, 11, specifically, for the shift position +100 mm in FIG. 8 and for the shift position −100 mm in FIG. 9. Of the roll contours 30 and 30', only the sector located in the given shift position in the reference width can be seen in each case. For purposes of comparison, the desired roll gap profiles 10, 11 are also plotted.

FIGS. 10 to 17 show how the roll gap contours with polynomials of second and fourth degree selected in FIGS. 6 to 9 can be transferred to two roll pairs that can be shifted independently of each other.

FIGS. 10 and 11 show the selected desired roll gap profiles 20 and 21 of the second-degree polynomial known from FIGS. 6 and 7. The determined profile heights of the shift positions lead to the roll contours 31, 31' (FIG. 12 and FIG. 13) of the upper and lower roll for the reference width of these roll pairs P1, P2, P3, with which continuous variation of the parabolically shaped roll gap between the profile heights of the desired roll gap profiles 20 and 21 can be achieved.

In the same way, FIGS. 14 and 15 show the selected desired roll gap profiles 22 and 23 of the fourth-degree polynomial known from FIGS. 6 and 7. They lead to the roll contours 32 and 32' (FIG. 16 and FIG. 17) of the upper roll and lower roll and are likewise continuously variable within the shifting range.

With a roll pair P1, P2, P3 that has the profile of a fourth-degree polynomial, it is thus possible to have a sensitive effect on the so-called quarter waves from +50 μm through 0 to −50 μm, without the adjustment of the set of rolls for the second degree being subjected to an unfavorable change.

FIGS. 18 to 21 illustrate that the method is by no means limited to the use of second- and fourth-degree polynomials and to the influencing of quarter waves.

In FIG. 18, an almost parallel desired roll gap profile 25, which is intended to open only at the edges of the rolling stock, is required for a shift position of +100 mm. It is formed by addition of the functional curves 24 of polynomials of the degrees 2, 4, 6, 8, 10, 12, 14, and 16 with the profile heights 400, 100, 60, 43, 30, 20, 14, and 10 μm.

The roll gap profile is intended to vary continuously to 0 by the shift of the desired roll gap profile 25. Therefore, in FIG. 19, the roll gap profile 26 with profile height=0 is required for the opposite shift position of −100 mm.

FIGS. 20 and 21 show the corresponding roll contours 33 and 33' for the upper roll and the lower roll. We see the opening of the roll gap that is strived for by the decrease of the desired roll gap profile 25 (FIG. 20) to the edges of the rolling stock, which is reduced to 0 by shifting in the direction −100 mm (FIG. 21). At −100 mm, there is a parallel roll gap with slight S-shaped curvature at the edges of the rolling stock. A roll pair shaped in this way allows sensitive correction of the decrease in thickness at the edges of the rolling stock. In accordance with the invention, a roll pair of this type can be used to advantage in combination with a roll pair for the parabolic contour according to FIGS. 10 to 13. With a suitable stand design, the additional incorporation of a correction possibility with rolls according to FIGS. 14 to 17 is also conceivable.

The invention is not limited to the illustrated embodiments. For example, the profile shapes of each shiftable roll pair P1, P2, P3 that can be produced in the roll gap 6 can each be described by two freely selectable symmetric profiles of an arbitrarily high degree, which are assigned to two likewise freely selectable shift positions. In accordance with an advantageous refinement of the invention, when a profile shape consisting of more than one power degree is selected, the profile heights of the individual power degrees are different for the two freely selectable shift positions. The result of this is that the shift position for producing the profile height 0 is different for the different power degrees, so that complementation of the roll contours is deliberately avoided.

Alternatively, the profile height of all powers is set to 0 for one of the two selectable shift positions in order to force complementation of the roll contours in this shift position. In accordance with the invention, the selected shift position for the profile 0 can also lie outside the real shifting range.

Moreover, in accordance with the invention, when a profile shape consisting of more than two power degrees with powers greater than 2 is selected, it is also possible for the profile heights of the individual power degrees to be selected for the two freely selectable shift positions in such a way that the distance of the two profile maxima varies continuously from a minimum to a maximum by the roll shifting.

The invention is also not limited to the use of polynomials. For example, it is immediately possible to provide individual roll pairs P1, P2, P3 with contours that follow transcendental functions or exponential functions. To this end, the transcendental functions or exponential functions are mathematically resolved into power series.

The operational application or the actual shifting of the individual roll pairs is accomplished in a well-known way by inserting the shifting systems of the roll pairs P1, P2, P3 as adjusting systems into a closed-loop flatness control system. By measurement of the tensile stress distribution over the strip width of the rolling stock, the present flatness of the rolling stock is determined and compared with a set point. The deviations over the strip width are analyzed by power degrees and assigned as control values to the individual roll pairs P1, P2, P3 according to the power degrees that can be influenced by them. With reference to the example illustrated in FIGS. 6 and 7, control values for eliminating center waves would be assigned to the roll pair for producing the desired roll gap profiles 20, 21, and control values for eliminating quarter waves would be assigned to the roll pair for producing the desired roll gap profiles 22, 23.

In the case of relatively large rolling stock thicknesses, in which defects in the profile shape would not yet be noticeable as flatness defects, the flatness measurement by measurement of the tensile stress distribution is replaced in the closed-loop control system by direct profile measurement in the form of a measurement of the thickness distribution over the width of the rolling stock.

LIST OF REFERENCE SYMBOLS

1 four-high stand
1' six-high rolling stand
1" 10-high rolling stand
2 work rolls
3, 3', 3" intermediate rolls
4, 4', 4" backup rolls
5 rolling stock
6 roll gap, roll gap cross section, roll gap profile in general
7 roll center
8 center of stand, center line
$b_0$ reference width
P1, P2, P3 roll pairs, shiftable
10 resultant desired roll gap profile of second and fourth degree for shift position +100 mm
11 resultant desired roll gap profile of second and fourth degree for shift position −100 mm
20 desired roll gap profile of second degree for shift position +100 mm
21 desired roll gap profile of second degree for shift position −100 mm
22 desired roll gap profile of fourth degree for shift position +100 mm
23 desired roll gap profile of fourth degree for shift position −100 mm
24 desired roll gap profile of second to sixteenth degree for shift position +100 mm
25 additive desired roll gap profile of the profiles from 24
26 desired roll gap profile=0 for shift position −100 mm
30 roll contour of the upper roll for the desired roll gap profile according to 10 and 11
30' roll contour of the lower roll for the desired roll gap profile according to 10 and 11

31 roll contour of the upper roll for the desired roll gap profile according to 20 and 21

31' roll contour of the lower roll for the desired roll gap profile according to 20 and 21

32 roll contour of the upper roll for the desired roll gap profile according to 22 and 23

32' roll contour of the lower roll for the desired roll gap profile according to 22 and 23

33 roll contour of the upper roll for the desired roll gap profile according to 25 and 26

33' roll contour of the lower roll for the desired roll gap profile according to 25 and 26

The invention claimed is:

1. Method for rolling plate or strip in a rolling stand (1, 1', 1") with work rolls (2) supported on backup rolls (4) or on intermediate rolls (3, 3', 3") with backup rolls (4, 4', 4"), wherein adjustment of a roll gap profile (6) is carried out by axial shifting of pairs of rolls (P1, P2, P3) provided with curved contours (30-33'), each pair of rolls including a work roll and a backup roll or an intermediate roll, wherein the adjustment of the roll gap profile (6) is carried out by at least two of the pairs of rolls (P1, P2, P3), which have differently curved contours (30, 30'; 31, 31'; 32, 32'; 33, 33') and are axially shifted independently of each other, wherein the different contours are calculated by splitting resultant desired roll gap profiles (10, 11) that describe the roll gap profile (6) into at least two different desired roll gap profiles (20, 21; 22, 23; 25, 26), the adjustment including axially shifting each respective pair of the at least two pairs of rolls.

2. Method in accordance with claim 1, wherein one of two roll pairs (P1, P2, P3) that can be axially shifted independently of each other is assigned desired roll gap profiles of second degree (20, 21), which result in curved roll contours of third degree (31, 31'), with which a profile maximum in the center line (8) that can be varied by roll shifting is obtained, while the second roll pair receives desired roll gap profiles of fourth degree (22, 23), which result in curved roll contours of fifth degree (32, 32'), which yield a roll gap profile that can be varied by roll shifting and that has two equal profile maxima that are symmetric with respect to the center line (8).

3. Method in accordance with claim 1, wherein first the resultant desired roll gap profiles (10, 11) to be established for the definition of the roll gap profile (6) that can be varied by roll shifting are expanded as nth-degree polynomials with even-numbered exponents, and these are then split into desired roll gap profiles (20, 21) with second-degree polynomials and into desired roll gap profiles (22, 23; 25, 26) with the residual polynomials, which cover all higher power degrees.

4. Method in accordance with claim 1, wherein, to adjust the roll gap profile (6), several roll pairs (PI, P2, P3) with desired roll gap profiles (20, 21; 22, 23; 25, 26) are used, in which the given distance from the center line (8) of the profile maxima of the roll gap profile (6) that is produced is different.

5. Method in accordance with claim 1, wherein, for a roll pair (P1, P2, P3), the desired roll gap profile (25) for one shift position is formed as the sum of profiles (24) with even-numbered powers of degree 2, 4, 6, . . . n by selection of the associated profile heights in such a way that, over a wide range of the width, a quasi-straight curve of the desired roll gap profile (25) is obtained, which deviates from the straight line only in the edge region, and that the desired roll gap profile (26) for the second shift position receives the profile height 0 for all selected powers, so that a quasi-parallel roll gap (6) that deviates from parallelism only in the edge region is obtained between the roll contours (33, 33').

6. Rolling stand (1, 1', 1") for rolling plate or strip with work rolls (2) supported on backup rolls (4) or on intermediate rolls (3, 3', 3") with backup rolls (4, 4', 4"), wherein adjustment of the roll gap profile (6) is carried out by axial shifting of pairs of rolls (P1, P2, P3) provided with curved contours (30-33'), for carrying out the method in accordance with claim 1, wherein at least two roll pairs (P1, P2, P3) are axially shifted independently of each other and have different roll contours (30, 30'; 31, 31'; 32, 32'), wherein the contours of the rolls of a roll pair (P1, P2, P3) are shaped in such a way that they produce in the roll gap (6) a profile (20, 21) symmetric with respect to the center line (8) with a profile maximum in the center line (8) that is varied by the roll shifting, while the contours of the rolls of at least a second roll pair (P1, P2, P3) in the roll gap (6) result in a profile (22, 23) which is symmetric with respect to the center line (8) and is comprising two equal maxima that are symmetric with respect to the center line (8) and are variable by axially shifting each respective pair of the at least two roll pairs.

7. Rolling stand (1, 1', 1") in accordance with claim 6, wherein several roll pairs (P1, P2, P3) are provided with two maxima that are symmetric with respect to the center line (8), which are located different distances from the center line (8).

8. Rolling stand (1, 1', 1") in accordance with claim 6, wherein additional polynomial components of higher degree are superimposed on the roll pair (P1, P2, P3) with a central profile maximum (20, 21).

9. Rolling stand (1, 1', 1") in accordance with claim 6, wherein the profile shapes (20, 21; 22, 23; 25, 26) of each shiftable roll pair (PI, P2, P3) which can be produced in the roll gap (6) are each described by two freely selectable symmetric profiles of an arbitrarily high degree, which are assigned to two likewise freely selectable shift positions.

10. Rolling stand (1, 1', 1") in accordance with claim 9, wherein, when a profile shape (20, 21; 22, 23; 25, 26) consisting of more than one power degree is selected, the profile heights of the individual power degrees are different for the two freely selectable shift positions, so that complementation of the roll contours (30-33') is deliberately avoided.

11. Rolling stand (1, 1', 1") in accordance with claim 9, wherein, when a profile shape (20, 21; 22, 23; 25, 26) consisting of more than two power degrees is selected, the adjustment ranges of the individual power degrees are selected for the two freely selectable shift positions in such a way that the distance of the two profile maxima varies continuously from a minimum to a maximum by the roll shifting.

12. Rolling stand (1, 1', 1") in accordance with claim 6, wherein the contours (31, 31') of the rolls of the roll pair (P1, P2, P3) with a central profile maximum (20, 21) follow the mathematical function of a third-degree polynomial, while the contours (32, 32') of the rolls (P1, P2, P3) with two profile maxima (22, 23) that are symmetric with respect to the center line (8) follow the mathematical function of a fifth-degree polynomial, which has the profile height 0 in the center line (8) and at the edge of the reference width.

13. Rolling stand (1, 1', 1") in accordance with claim 6, wherein profile heights of all powers are set to 0 for one of the two selectable shift positions in order to force complementation of the roll contours in this shift position.

14. Rolling stand (1, 1', 1") in accordance with claim 13, wherein the selected shift position for a profile 0 also lies outside the real shifting range.

15. Rolling stand (1, 1', 1") in accordance with claim 6, wherein the freely selectable coefficients for the linear components of the roll profile of each roll pair (P1, P2, P3) are selected in such a way that the axes of each of the two rolls of the roll pair (P1, P2, P3) under rolling load roll parallel with the axes of the rolls that support them.

16. Rolling stand in accordance with claim 6, wherein the shiftable intermediate rolls (3) are provided with a profile (31, 31') which a polynomial with a central profile maximum (20, 21) produces in the roll gap (6), and the shiftable work rolls (2) are provided with a profile (32, 32') which a residual polynomial (22, 23) with two maxima that are symmetric to the center line (8) produces in the roll gap (6).

* * * * *